US006045072A

United States Patent [19]

Zehr

[11] Patent Number: 6,045,072

[45] Date of Patent: Apr. 4, 2000

[54] SLOTTED HAMMERMILL HAMMER

[75] Inventor: Melvin A. Zehr, Middleton, Id.

[73] Assignee: Diamond Z Manufacturing, Caldwell, Id.

[21] Appl. No.: 09/258,098

[22] Filed: Feb. 25, 1999

[51] Int. Cl.[7] ..... B02C 13/02; B02C 13/28

[52] U.S. Cl. ..... 241/189.1; 241/191; 241/195; 241/197; 241/300

[58] Field of Search ..... 241/189.1, 191, 241/195, 197, 291, 300

[56] References Cited

U.S. PATENT DOCUMENTS

| | | | |
|---|---|---|---|
| 1,681,779 | 8/1928 | Ossing | 241/191 |
| 1,694,423 | 12/1928 | Liggett | 241/191 |
| 1,761,083 | 6/1930 | Liggett | 241/191 |
| 3,367,585 | 2/1968 | Ratkowski | 241/197 |
| 3,642,214 | 2/1972 | Blackwell, Jr. | 241/191 |
| 3,844,494 | 10/1974 | Hightower | 241/197 |
| 4,046,327 | 9/1977 | Cranor | 241/197 |
| 4,241,882 | 12/1980 | Baikoff | 241/236 |
| 4,313,575 | 2/1982 | Stepanek | 241/194 |
| 4,650,129 | 3/1987 | Newell et al. | 241/73 |
| 4,717,083 | 1/1988 | Quast et al. | 241/197 |
| 4,997,135 | 3/1991 | Zehr | 241/101.7 |
| 5,285,974 | 2/1994 | Cesarini | 241/194 |
| 5,950,945 | 9/1999 | Schaller | 241/189.1 |
| 5,967,436 | 10/1999 | Balvanz | 241/291 |

*Primary Examiner*—John M. Husar
*Attorney, Agent, or Firm*—Frank J. Dykas

[57] ABSTRACT

An improved hammermill hammer is provided wherein the hammer body has an interlocking slot, to receive one of a pair of retaining rods, and a rod hole through which a second rod is interfitted to lock the hammer securely to the hammermill rotor.

7 Claims, 6 Drawing Sheets

SLOTTED HAMMERMILL HAMMER

BACKGROUND OF THE INVENTION

1. Technical Field

This invention generally relates to hammers used in hammermill assemblies, and more particularly to a non-swinging hammer held in place by a pair of rods wherein the hammer body has an interlocking slot to receive one rod, and a rod hole through which a second rod is interfitted.

2. Background

Hammermills are used to grind a disparate and wide range of materials, including such things as tree stumps and slash from logging operations, land fill trash, to food products, such as grinding apples into mash in preparation for making apple cider. A typical hammermill assembly is formed of a rotor assembly to which a number of hammers are attached, a fixed cutter bar positioned alongside of the rotor assembly and in close relationship to where the hammers will pass by it, and beneath the rotor assembly a semi-circular screen. Material is dropped into the hammermill from the top, where it is impacted by the rotating hammers, and rotated around to a point where larger material will also impact the cutter bar and break, and then pass beneath the cutter bar into proximity to the screen. Depending upon the screen size, the smaller material will pass through the screen to a collection point beneath the hammer mill.

FIG. 1 discloses a portion of a typical prior art hammermill assembly in an exploded view. It shows the central rotor shaft, which, in the prior art, is typically a keyed shaft and a plurality of alternatingly arranged spacers and hammer rings. Hammer bodies are sized to interfit between the hammer rings and are provided with two rod holes. A plurality of hammer rods can then be inserted through aligned sets of rod holes in both the hammer rings and the hammer bodies to lock the hammers firmly in place. While there are other designs for hammermills which provide for swinging hammers which are held out in an extended position by centrifugal force, this design for a fixed hammer is quite common.

The problem is that the hammers undergo substantial wear and stress during operation. As a result, as shown in the prior art FIG. 1, there is often times a wear tip bolted to the tip of the hammer head to reduce wear. However, even with the wear tip, hammers do occasionally, and in some cases routinely, break, and therefore must be periodically replaced.

Hammermills used for many applications must be very stoutly built using high strength alloys of steel which must be machined to relatively close tolerances. As a result, when a hammer head breaks off, two sets of hammer rods must be unbolted from the hammer mill assembly and removed to release the broken hammer so that it can be replaced.

If the broken hammer resides in the middle of the hammermill assembly, this may result in the withdrawal of the hammer rods past many rings to get at the broken hammer, resulting in the removal and reinstallation of a number of hammers just to replace the broken interior hammer.

This is not always an easy thing to do. The hammer rod must be unscrewed or unfastened from the hammer rings. If any of the rings or the rod have deformed during operation, the rods may not be easy to remove. In fact, in a number of applications, for example that which is disclosed in the grinding apparatus shown in U.S. Pat. No. 4,997,135 to Zehr, special built-in hammer rod extractors or punches are provided to hydraulically push out the hammer rods so that broken or worn hammers may be repaired or replaced. Also, it should be apparent that in the prior art, in order to replace one hammer you have to push out and remove two hammer rods. Thus, all of the other hammers that precede the broken hammer must be also removed and then reinstalled. At best, this is a time consuming and difficult job.

Accordingly, what is needed is a hammer design for a fixed hammer, as opposed to a swinging hammer that can be removed by the removal of only one hammer rod, as opposed to two. The achievement of this object also achieves secondary objects, such as greatly simplifying the process of replacing broken or worn hammers, and greatly reducing the amount of time it takes to do so.

DISCLOSURE OF INVENTION

These objects are achieved through the use of an slotted hammer assembly which is installed and used with a conventional hammermill rotor assembly formed of a rotor shaft and a plurality of alternating spacers and hammer rings between which the hammer assemblies can be interfitted and held in place by means of hammer rods.

Each hammer ring in the hammermill rotor assembly is provided with a radial array of ring rod holes, which are sized to receive and hold hammer rods. A plurality of hammer rod bolts are provided to hold the rods firmly in place once the hammers have been installed.

In the present invention, each hammer assembly is provided with a metal body, which contains one hammer rod hole and one hammer rod slot. The hammer assembly is first slid over and interlocked with a pre-installed hammer rod, which is held firmly in place within a hammer rod slot. Next, a second hammer rod can be inserted through the array of ring rod holes in the hammer rings to firmly lock the hammer body in position.

The hammer assembly is configured with a hammer head which extends out from the hammer body in a configuration where it will be radially extending out from the rotor assembly. The hammer head is provided with a recessed surface, along with a pair of ribbed shoulders and a single bolt hole, all of which are configured to receive a conforming attachment collar of a wear tip which interfits within the recessed surface and against the ribbed shoulders to firmly lock the wear tip in position. A single bolt, which is countersunk into the wear tip, is provided to hold the wear tip in position.

BEST MODE FOR CARRYING OUT INVENTION

Figure 2:
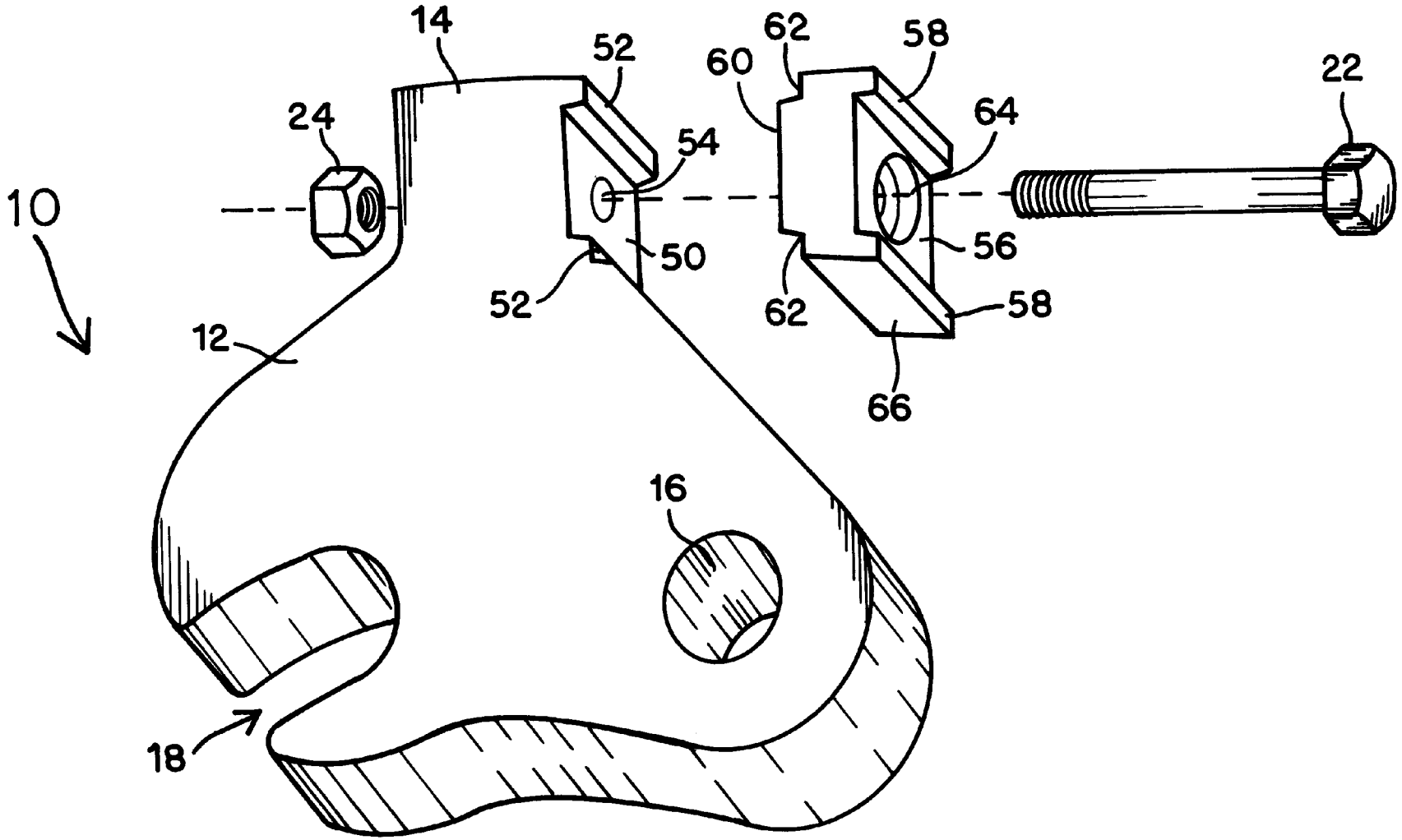
FIG. 2 is a perspective representational view of the slotted hammermill hammer and improved wear tip.
Figure 3:
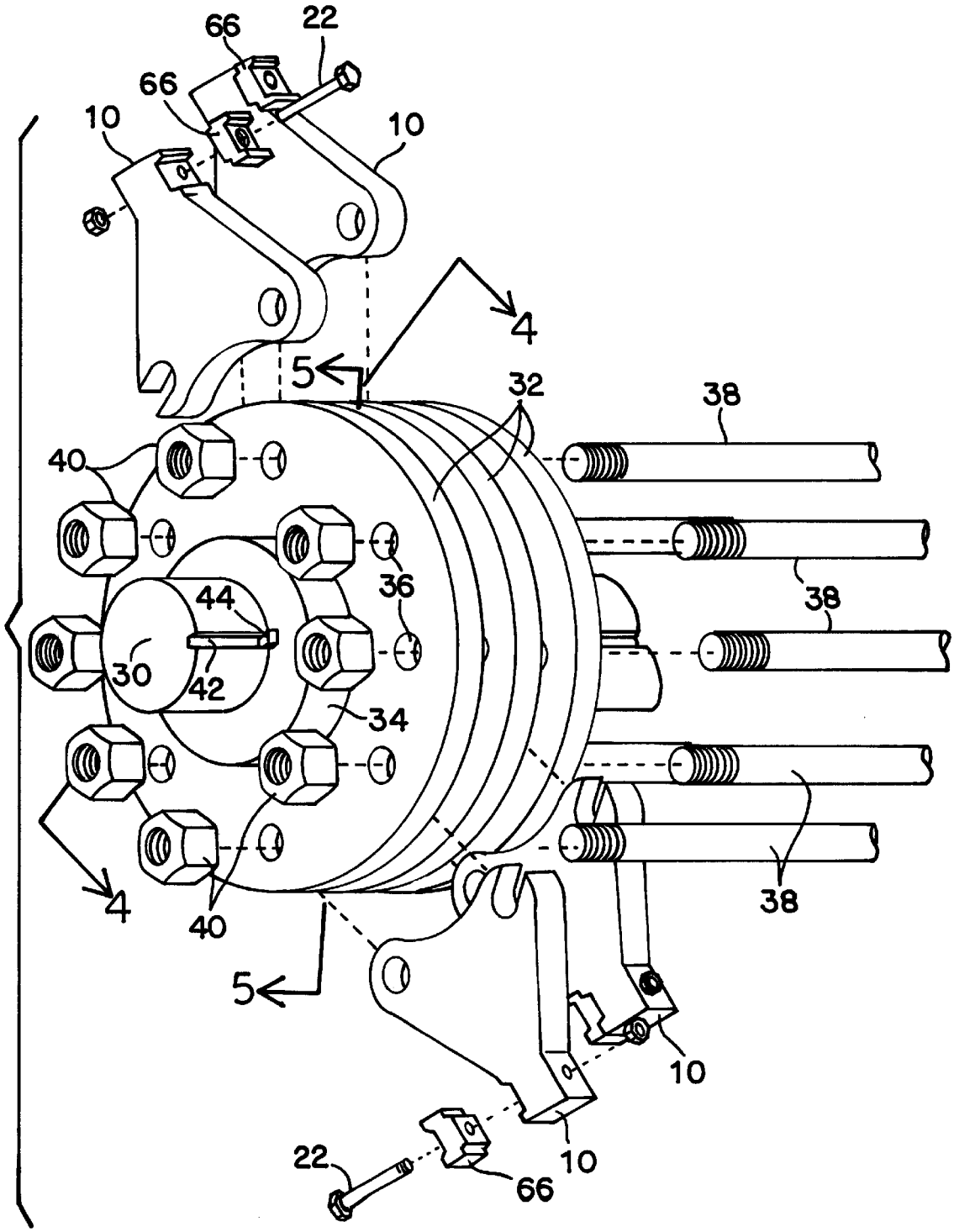
FIG. 3 is a perspective exploded representational view of a portion of a hammermill assembly, showing the slotted hammermill hammers.
Figure 4:
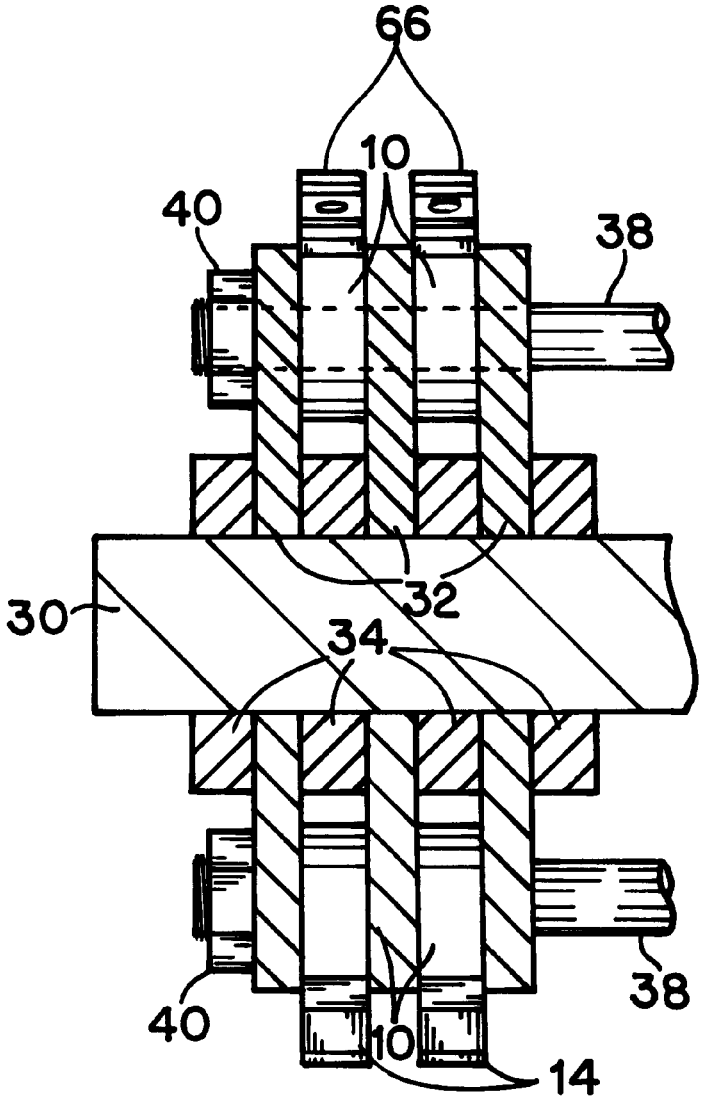
FIG. 4 is a sectional side view of the section of the hammermill assembly shown in FIG. 3 in an assembled configuration taken along the plane 4—4.

Referring to FIGS. 2 through 5, there is shown slotted hammer assembly 10 as it is installed and used in a conventional hammermill assembly rotor. Referring to FIGS. 3 and 4, there is shown a conventional hammermill rotor assembly formed of rotor shaft 30, onto which are attached a plurality of alternating spacers 34 and hammer rings 32. Spacers 34 are configured to separate hammer rings 32 to a desired width, such that hammer assemblies 10 can be interfitted between them and held in place by means of hammer rods 38. Spacers 34 and hammer rings 32 are attached to rotor 30 by means of a conventional key 44 interfitting within key ways 42. Not shown, but well known in the art are the end caps or bolts which are used to hold the entire rotor assembly together.

Each hammer ring 32 is provided with a radial array of ring rod holes 36, which are sized to receive and hold hammer rods 38. A plurality of hammer rod bolts 40 are provided to hold the rods firmly in place.

Figure 1:
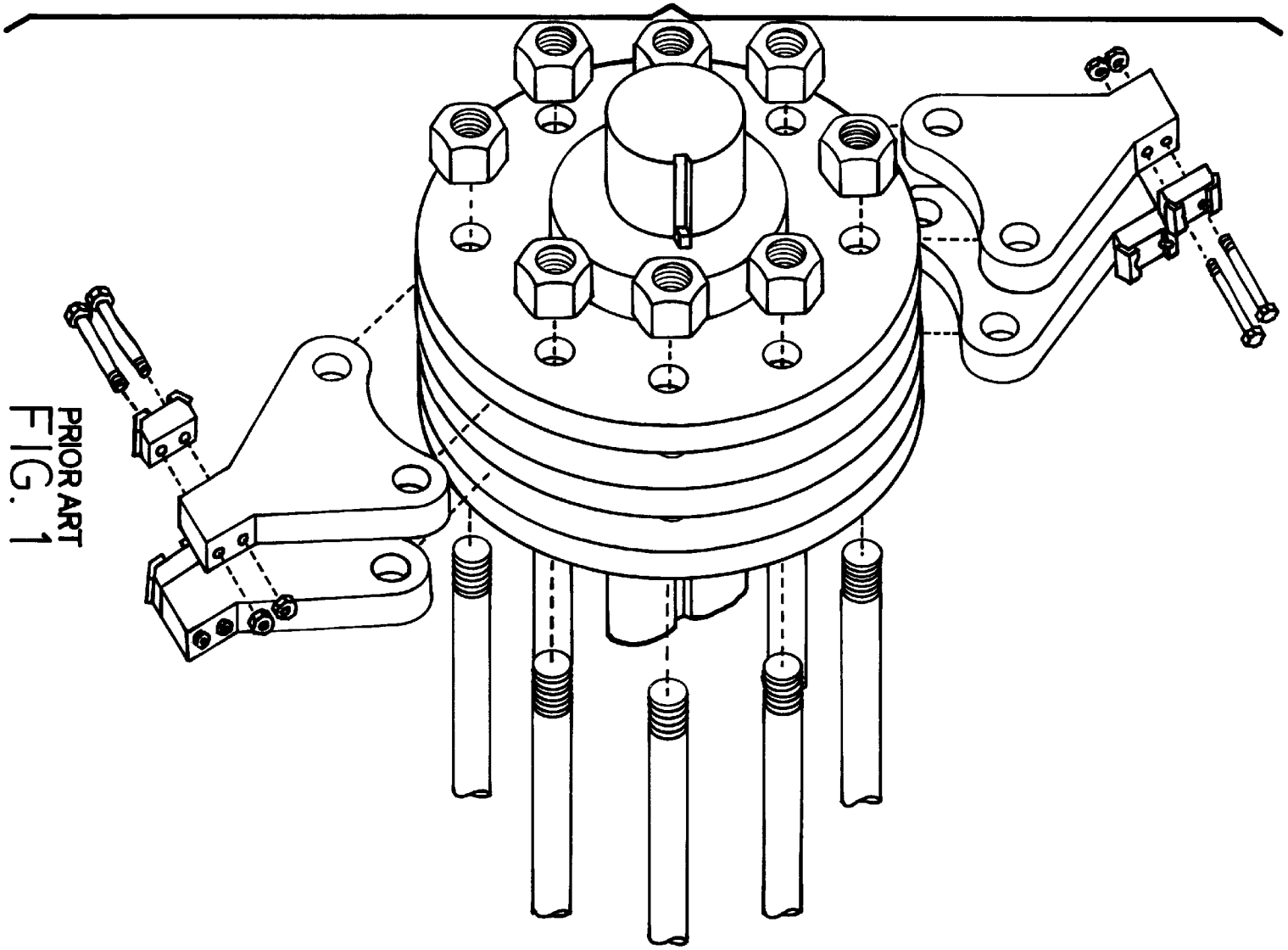
PRIOR ART FIG. 1
FIG. 1 is an exploded perspective representational view of a portion of a hammermill assembly showing prior art hammer designs.

In the prior art, as is shown in FIG. 1, each prior art hammer is provided with two hammer rod holes through which the hammer rods are inserted to hold the hammer firmly in place. Thus, if a hammer breaks or wears to the point where it needs replacement, two hammer rods need to be removed in order to change the hammer.

Figure 5:
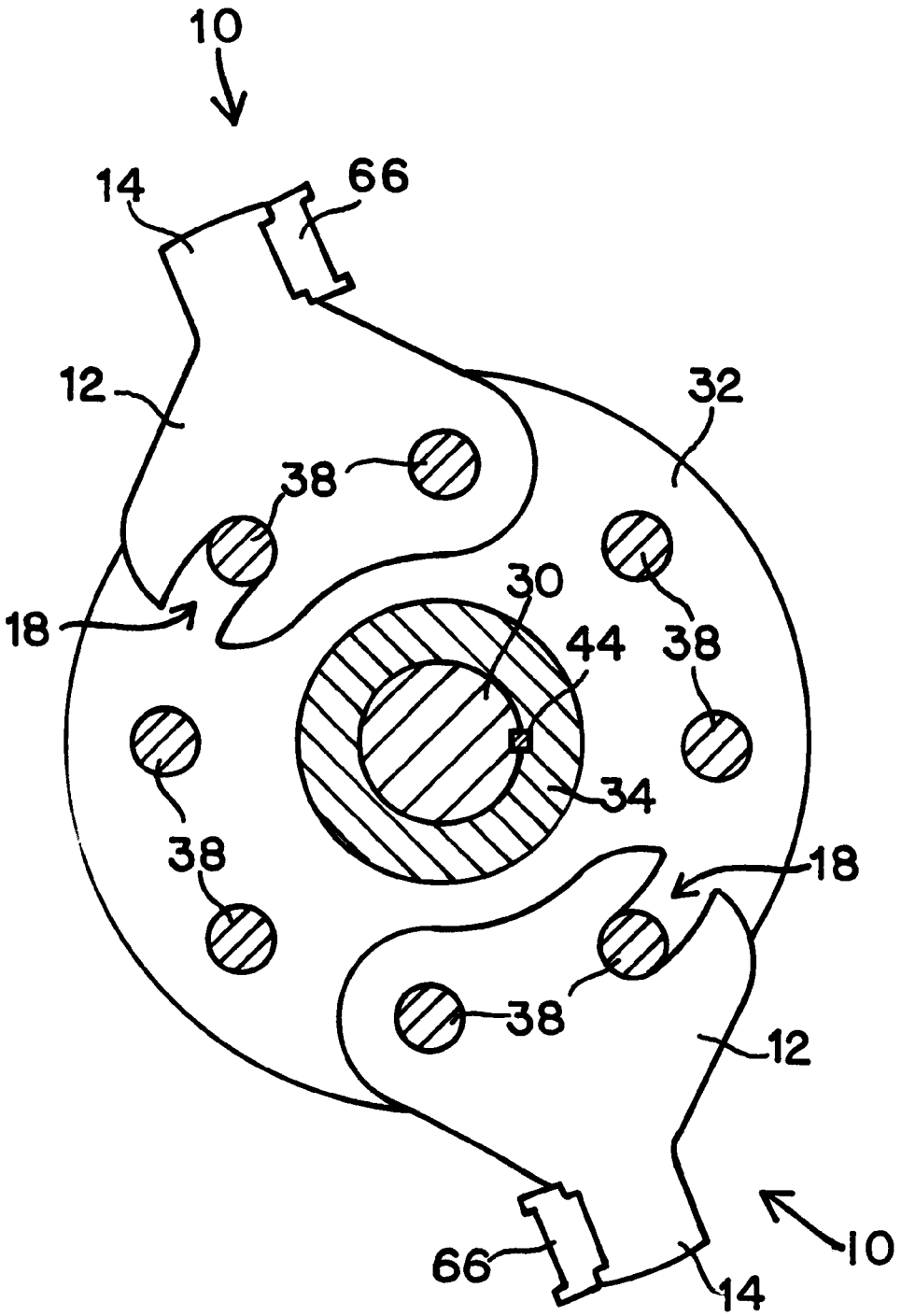
FIG. 5 is a sectional side view of the hammermill assembly showing hammers installed, taken along the plane 5—5 of FIG. 3.
Figure 6:
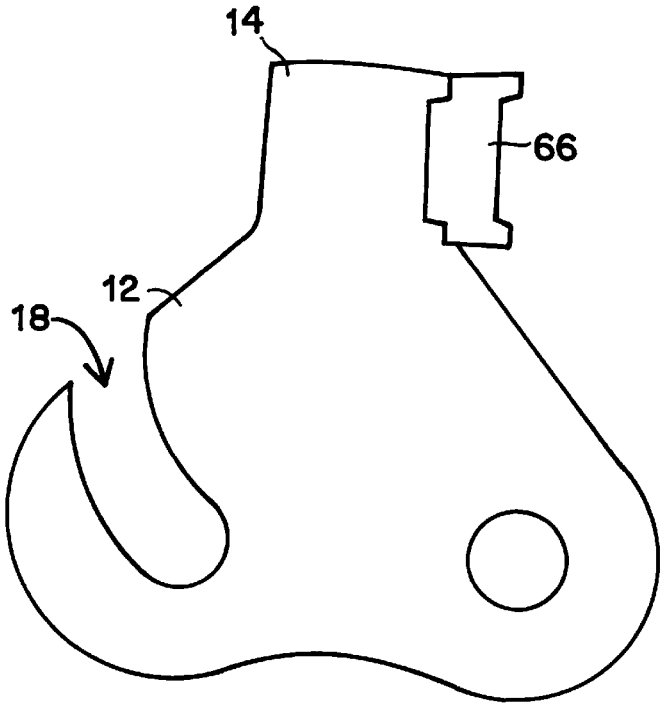
FIG. 6 is a side plan view of a second embodiment of slotted hammermill hammer.
Figure 7:
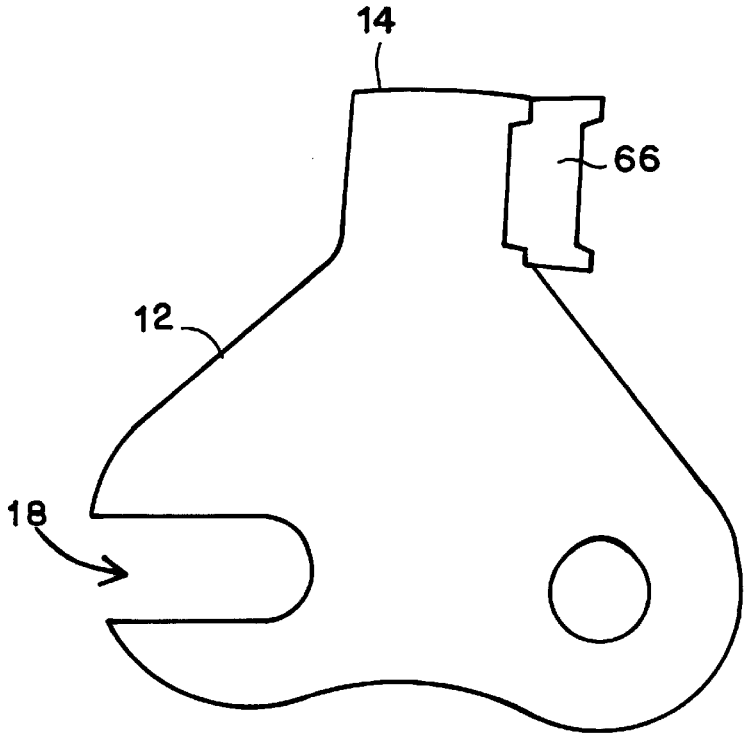
FIG. 7 is a side plan view of a third embodiment of slotted hammermill hammer.

In the present invention, as shown in FIGS. 2, 3 and 5, each hammer assembly 10 is provided with a cast body 12 which contains one hammer rod hole 16 and one hammer rod slot 18 formed within or machined into cast body 12. Hammer rod slot 18 sized to receive and interlock with a hammer rod 38. Hammer rod slot 18 can be oriented in any number of directions as is shown by way of example in the second and third embodiments of FIGS. 6 and 7, as long as a portion of cast body 12 will continue to remain engaged with hammer rod 38 under the centrifugal forces induced by rotation of the hammermill assembly during operation. As shown in FIG. 5, hammer rod slot 18 in cast body 12 of the hammer assembly 10 is first slid over and interlocked with a pre-installed hammer rod 38, where it is held firmly in place within hammer rod slot 18. Next, a second hammer rod 38 can be inserted through the array of ring rod holes 36 in hammer rings 32 to firmly lock the hammer body 12 in position.

Also, as shown in FIGS. 2 and 3, an improved wear tip 66 is provided over that shown in the conventional prior art of FIG. 1. In the prior art, a pair of bolt holes are simply drilled through the hammer head and the wear tip is bolted directly to the hammer body. In the present invention, hammer head 14 extends out from hammer body 12 in a configuration where it will be radially extending out from the rotor assembly. Instead of a pair of bolt holes as is shown in the prior art of FIG. 1, a recessed surface 50 is provided, along with a pair of shoulders 52. Also provided is a single bolt hole 54. The improved wear tip 66 has a conforming extended portion or attachment collar 60, which interfits within recessed surface 50, with shoulder recess 62, which are part of the wear tip body, lodged against ribbed shoulders 52 to firmly lock wear tip 66 in position, such that a single bolt 22 and nut 24 can be used to attach wear tip 66 to hammerhead 14. Wear tip 66 is also provided with a recessed surface 56 and through hole 64 to receive the head of bolt 22 in a countersunk position where it will not be subject to as much wear as it otherwise would be. Hardened wear surfaces 58 is complete wear tip 66.

In use, wear tip 66 is found to distribute the shock and impact forces of hammering more uniformly through hammer head 14, which results in a lower breakage and wear rate for hammers 10.

Also, in practice, it is found that the time it takes to remove hammer rods 38 for purposes for replacement of a broken hammer is almost halved, thus saving the operator significant down time and expense.

While there is shown and described the present preferred embodiment of the invention, it is to be distinctly understood that this invention is not limited thereto but may be variously embodied to practice within the scope of the following claims.

I claim:

1. A slotted hammermill hammer for use with a rotatable hammermill having a rotor shaft, a plurality of circumvolving hammer rings attached to said rotor shaft and held in spaced relationship to each other to receive between them, in interfitting relationship said hammer, said hammer rings each having at least two hammer ring rod holes, each of which are aligned with corresponding hammer ring rod holes in remaining hammer rings to form sets of aligned hammer ring rod holes so as to receive and hold within each of said sets of hammer ring rod holes an elongated hammer retaining rod, and first and second elongated hammer retaining rods each configured for insertion through said aligned sets hammer ring rod holes in said hammer rings, said slotted hammermill hammer comprising:

a hammer body having a peripheral edge and configured for interfitting relationship between a pair of said hammer rings, said hammer body having a slot extending into said hammer body from said peripheral edge for engaging an elongated hammer retaining rod inserted and held within a set of aligned hammer ring rod holes of said hammer rings when said hammer body is interfitted between a pair of said hammer rings, said slot being oriented in any direction which permits said hammer body to in contact with said first hammer rod when said hammer is subjected to centrifugal forces of hammermill rotation, and a hammer body rod hole through which said second elongated hammer retaining rod may be inserted when said second elongated hammer retaining rod is inserted and held within another set of said aligned hammer ring rod holes of said hammer rings.

2. The hammer of claim 1 which further comprises:

a hammer head attached to and extending out from said hammer body along a radial axis relative to said rotor shaft.

3. The hammer of claim 2 which further comprises:

said hammer head being configured to receive and hold a wear tip; and a wear tip held by said hammer head.

4. The hammer of claim 3 wherein said hammer head configuration to receive and hold a wear tip further comprises:

a recessed surface formed in said hammer head between at least a pair of opposing shoulders for receiving said wear tip.

5. The hammer of claim 4 wherein said wear tip further comprises:

a wear tip body having an extended portion on one side of conforming shape for interfitting within said hammer head recessed surface with both said extended portion in contact with said recessed surface and said body in contact with said shoulders.

6. The hammer of claim 5 which further comprises:

a wear surface formed on said body opposite to said extended portion;

a bolt head receiving recessed surface formed within said wear surface for receiving the head of a bolt;

said body further having a bolt hole communicating between said bolt head receiving recessed surface and said extended portion of said wear body;

a hammer head bolt hole communicating between said recessed surface and the surface of said hammer head opposite said recessed surface; and a bolt having a bolt head configured in size to extend through said bolt holes in said wear body and said hammer head with said bolt head within said bolt head receiving recessed surface.

7. An improved hammermill hammer for use with a rotatable hammermill having a rotor shaft, a plurality of circumvolving hammer rings attached to said rotor shaft and held in spaced relationship to each other to receive between them, in interfitting relationship said hammer, said hammer rings each having at least two hammer ring rod holes, each of which are aligned with corresponding hammer ring rod holes in remaining hammer rings to form sets of aligned hammer ring rod holes so as to receive and hold within each of said sets of hammer ring rod holes an elongated hammer retaining rod, and first and second elongated hammer retaining rods each configured for insertion through said aligned sets hammer ring rod holes in said hammer rings, said slotted hammermill hammer comprising:

a hammer body configured for interfitting relationship between a pair of said hammer rings, said hammer body having at least a pair of hammer body rod holes through which said elongated hammer retaining rods may be inserted when said elongated hammer retaining rods are inserted and held within sets of said aligned hammer ring rod holes of said hammer rings;

a hammer head attached to and extending out from said hammer body along a radial axis relative to said rotor shaft, said hammer head having recessed surface formed in said hammer head between at least a pair of opposing shoulders for receiving said wear tip said hammer head further having a hammer head bolt hole communicating between said recessed surface and the surface of said hammer head opposite said recessed surface;

a wear tip having a wear tip body having an extended portion on one side of conforming shape for interfitting within said hammer head recessed surface with both said extended portion in contact with said recessed surface and said body in contact with said shoulders, said wear tip further having a wear surface formed on said body opposite to said extended portion and a bolt head receiving recessed surface formed within said wear surface for receiving the head of a bolt and a bolt hole communicating between said bolt head receiving recessed surface and said extended portion of said wear body; and a bolt having a bolt head configured in size to extend through said bolt holes in said wear body and said hammer head with said bolt head within said bolt head receiving recessed surface.

* * * * *